US007689143B2

(12) United States Patent
Silva et al.

(10) Patent No.: US 7,689,143 B2
(45) Date of Patent: Mar. 30, 2010

(54) PIN DRIVER

(75) Inventors: Gary Silva, Reseda, CA (US); Valeriy Kiselev, Pasadena, CA (US); Gerardo Martinez, Winnetka, CA (US)

(73) Assignee: Future Graphics Imaging Corporation, San Fernando, CA (US)

( * ) Notice: Subject to any disclaimer, the term of this patent is extended or adjusted under 35 U.S.C. 154(b) by 685 days.

(21) Appl. No.: 11/647,115

(22) Filed: Dec. 28, 2006

(65) Prior Publication Data

US 2008/0159779 A1 Jul. 3, 2008

(51) Int. Cl.
*G03G 15/00* (2006.01)

(52) U.S. Cl. ..... 399/109; 399/159

(58) Field of Classification Search ..... 399/109, 399/159

See application file for complete search history.

(56) References Cited

U.S. PATENT DOCUMENTS

2004/0005169 A1* 1/2004 Yokomori et al. ..... 399/159
2004/0034978 A1* 2/2004 Crevoisier ..... 29/270
2009/0257775 A1* 10/2009 Silva et al. ..... 399/109

OTHER PUBLICATIONS

Product discription page from Static Control Component's website www.scc-inc.com accessed Feb. 5, 2009 titled Drum Drive Pin Removal/Insertion Punch Tool for HP3500/3700.
Product discription page from Static Control Component's website www.scc-inc.com accessed Feb. 5, 2009 titled HP3500/3700 Drum Drive Pin Removal/Insertion Tool.
Product discription page from Static Control Component's website www.scc-inc.com, accessed Feb. 5, 2009 titled Type 2 Drum Drive Pin Removal/insertion Tool for HP3500/3700.

* cited by examiner

*Primary Examiner*—David M Gray
*Assistant Examiner*—Ryan D Walsh

(57) ABSTRACT

A device for driving a pin that fastens a printer cartridge drum to a printer cartridge at least on one end of the printer cartridge drum, the device comprising a device body defining a device body recess and a shaft configured to be inserted in the device body recess and to be moved within the device body recess, wherein the movement of the shaft within the device body recess is configured to drive the pin and alter the attachment of the printer cartridge to the printer cartridge at the at least one end of the printer cartridge drum.

14 Claims, 7 Drawing Sheets

PIN DRIVER

CROSS REFERENCE TO RELATED APPLICATIONS

None

FIELD OF THE INVENTION

The present invention relates to electrophotography, particularly methods and apparatus for remanufacturing toner cartridges.

BACKGROUND

Used printer cartridges of fax machines, copiers, inkjet printers, and laser printers are often remanufactured. Printer cartridges typically include a toner hopper, a waste hopper, primary charge roller or PCR, a developer roller, and a drum. Generally, printers embed toner on paper by relying on electrical charges occurring within the printer cartridges. The toner is typically stored in the toner hopper and carries a negative charge. The drum is typically given a charge by the PCR. The charge of the drum is typically more positive than the charge of the toner, and thus the drum is able to attract the toner. Once the drum is given a charge by the PCR and a print pattern is set, the drum gets coated with toner. The drum that is coated with toner then rolls over a sheet of paper, which is usually given a negative charge by the PCR. The charge of the paper is less negative than the charge of the toner, and thus the paper attracts the toner. The toner is embedded on the paper according to the print pattern.

The drum is usually one of the components that wears out from usage and gets replaced during remanufacturing. The drum is typically attached to a drum axle, which is attached to a motor of the printer and allows the motor to rotate the drum. In some cartridges, the drum is attached to the drum axle with a mechanical spring pin that is inserted through a portion of the drum and a portion of the drum axle. Examples of these cartridges include cartridges for Hewlett-Packard laser printer model numbers 3000, 3500, 3600, 3700, and 3800.

To detach the drums from the drum axles of the above cartridges, a hammer and a chisel is conventionally used. The chisel is first aligned with the mechanical spring pin. Once the chisel is aligned, a hammer is used to cause the chisel to drive the mechanical spring pin out of the drum and the drum axle thereby allowing the drum to be detached from the cartridge. Other methods of detaching the drums include using a punch in lieu of the chisel. The punch may include a flatter head than the chisel, which provides a wider surface of pin contact than the chisel. Consequently, the punch may more effectively contact and drive the mechanical spring pin out of the drum and the drum axle than the chisel.

At least one problem with the conventional methods and tools is that they expose the drum to being damaged. For instance, the drum may include drum hubs made of soft plastic. Since irregular force is applied to the drum hub by the hammer, the chisel, or the punch, the soft plastic of the drum hub may be deformed. Another problem with the conventional tools is that they do not ease the step of aligning the mechanical spring pin with the device used to drive the mechanical spring pin out of the drum and the drum axle. The chisel or the punch may contact the mechanical spring pin, but may easily slip from the mechanical spring pin. Yet another problem with the conventional tools is that they only provide leverage in detaching the drum from the cartridge. The conventional tools do not provide leverage when a drum needs to be attached to the cartridge. Thus, the conventional methods and tools may not be desirable in high volume cartridge remanufacturing environments. Methods and apparatus for efficiently and quickly detaching the drums from the cartridges and reattaching the same are desired and are addressed by the present invention.

BRIEF DESCRIPTION

A device for driving a pin that fastens a printer cartridge drum to a printer cartridge at least on one end of the printer cartridge drum, the device comprising a device body defining a device body recess and a shaft configured to be inserted in the device body recess and to be moved within the device body recess, wherein the movement of the shaft within the device body recess is configured to drive the pin and alter the attachment of the printer cartridge to the printer cartridge at the at least one end of the printer cartridge drum.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

Figure 1:
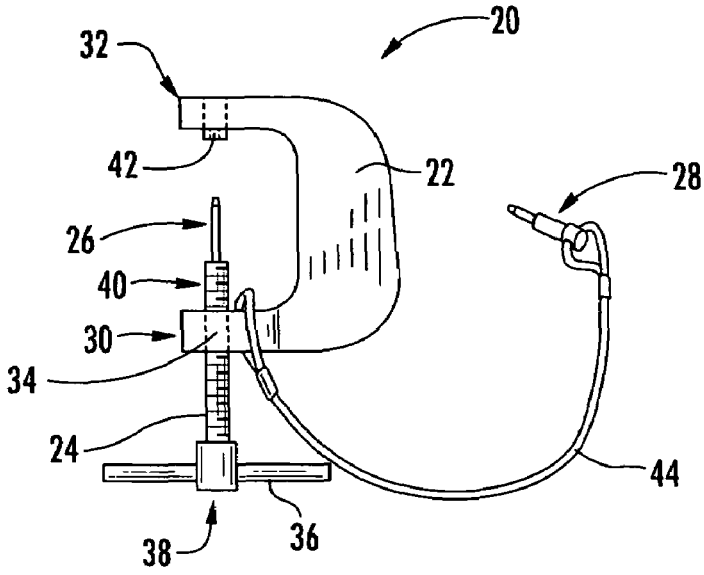
FIG. 1 is substantially a front elevational view of an embodiment of a pin driver of the present invention.

The present invention comprises a pin driver and related methods of use. Referring to FIG. 1, the pin driver 20 may include a tool body 22, a shaft 24, an engagement pin 26, and an alignment pin 28. The tool body 22 may have a C-shape structure, which defines a first end 30 and a second end 32. The first end 30 is preferably positioned at the bottom of the C-shape structure and preferably defines a first recess (not shown) proximate to the tip of the first end 30. The first recess is preferably configured to accommodate the shaft 24, which may be moved within the first recess. It can be appreciated that the first end portion 30 supports, at least partially, the movable shaft 24. Thus, the first end 30 of the tool body 22 may be thicker than the second end 32 to provide structural integrity to the first end portion 30.

The shaft 24 preferably includes continuous projecting helical ribs or male threads. The wall 34 that surrounds the first recess preferably includes corresponding set of female threads. The shaft 24 may be turned and moved within the first recess using a handle 36 attached to a first shaft end 38. It can be appreciated that the turning of the shaft 24 either elongates or shortens the length of the shaft 24, as measured from the first end 30 of the tool body 22. It can further be appreciated that the turning of the shaft 24 moves the tool body 22 up and down the shaft 24.

The shaft 24 preferably also includes a second shaft end 40, which is opposite the first shaft end 38 where the handle 36 is positioned. An engagement pin 26 is preferably attached to the second shaft end 40. The engagement pin 26 may be another shaft with a smaller diameter than the shaft 24 and may include an edge that tapers towards the tip. The edge may further include a substantially flat surface that is perpendicular to the engagement pin shaft. As the engagement pin 26 is attached to the shaft 24, the rotation of the shaft 24 also rotates the engagement pin 26. The engagement pin 26 is preferably configured to push a mechanical spring pin to detach a drum from a drum axle, as described below.

With continued reference to FIG. 1, the second end 32 of the pin driver 20 is preferably opposite the first end 30 of the C-shape structure of the tool body 22. In FIG. 1, the first end 30 is positioned on the bottom of the tool body 22, and thus the second end 32 is positioned on top of the tool body 22. The second end 32 preferably defines a second end recess 42 (shown in FIG. 9). The second end recess is preferably configured to accommodate the insertion of the alignment pin 28.

The alignment pin 28 is preferably tied to the shaft 24 using a tie 44 known in the art. It is noted that the alignment pin 28 is only optionally tied to the shaft 24 to ensure that the alignment pin 28 is not misplaced or lost and to provide an alignment pin 28 that can easily be grasped when needed. The alignment pin 28 need not be tied to the shaft 24. The alignment pin 28 may also be attached elsewhere around the pin driver 20 using methods known in the art.

Figure 2:
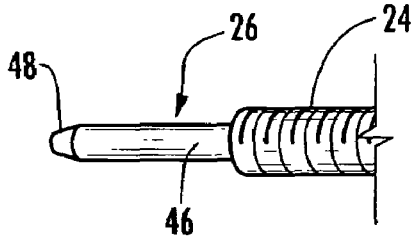
FIG. 2 is substantially a front elevational view of an embodiment of an engagement pin of the present invention.

Referring now to FIG. 2, the structure of the engagement pin 26 is shown in detail wherein the engagement pin 26 preferably includes an engagement pin shaft 46 directly attached to the shaft 24. The engagement pin shaft 46 preferably has a smaller diameter than the shaft 24. The engagement pin 26 preferably also includes a pin contact portion 48, which is preferably attached to the end of the engagement pin shaft 46 that is opposite to the end where the shaft 24 is attached. The pin contact portion 48 preferably includes a structure that tapers from the engagement pin shaft 46 to its tip. The pin contact portion 48 is preferably sized to fit inside a recess defined by the mechanical spring pin to be removed by the pin driver 20 (not shown).

Figure 3:
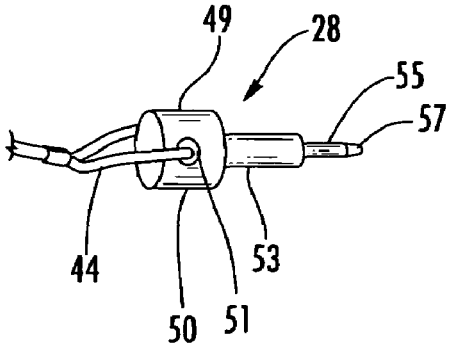
FIG. 3 is substantially a front elevational view of an embodiment of an alignment pin of the present invention.

Referring now to FIG. 3, the structure of the alignment pin 28 is shown in detail. The alignment pin 28 preferably includes an alignment pin head 49. The alignment pin head 49 may be cylindrical in shape and may define a pin head recess 51 to accommodate a tie 44, which may be used to attach the alignment pin 28 to the pin driver 20. An alignment pin shaft 53 is preferably attached to the alignment pin head 49. The alignment pin shaft 53 preferably has a smaller diameter than the alignment pin head 49. The alignment pin 28 preferably also includes an alignment pin contact portion 55 attached to the alignment pin shaft 53. The alignment pin contact portion 55 preferably includes a cylindrical body and an edge that tapers toward the tip and forms a pointed edge 57. It is noted that in other embodiments of the pin driver, the alignment pin head 49 may not include the pin head recess 51. The alignment pin shaft 53 and the cylindrical body of the alignment pin contact portion 55 may be integrated and may have uniform diameter.

The present invention also includes methods relating to the use of the pin driver 20. Before describing one of the methods, the order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

The cartridge to be remanufactured is preferably disassembled such that the drum can be accessed. In the description below, the drawings corresponding to the description depict cartridges from original equipment manufacturers (OEMs), including Hewlett Packard company's HP3700, HP 3500, HP 3800, HP 3600, and HP 3000 cartridges. It is noted that the application of the invention is not limited to Hewlett Packard cartridges. The invention may be used with cartridges from various manufacturers.

Drum Disassembly

Figure 4:
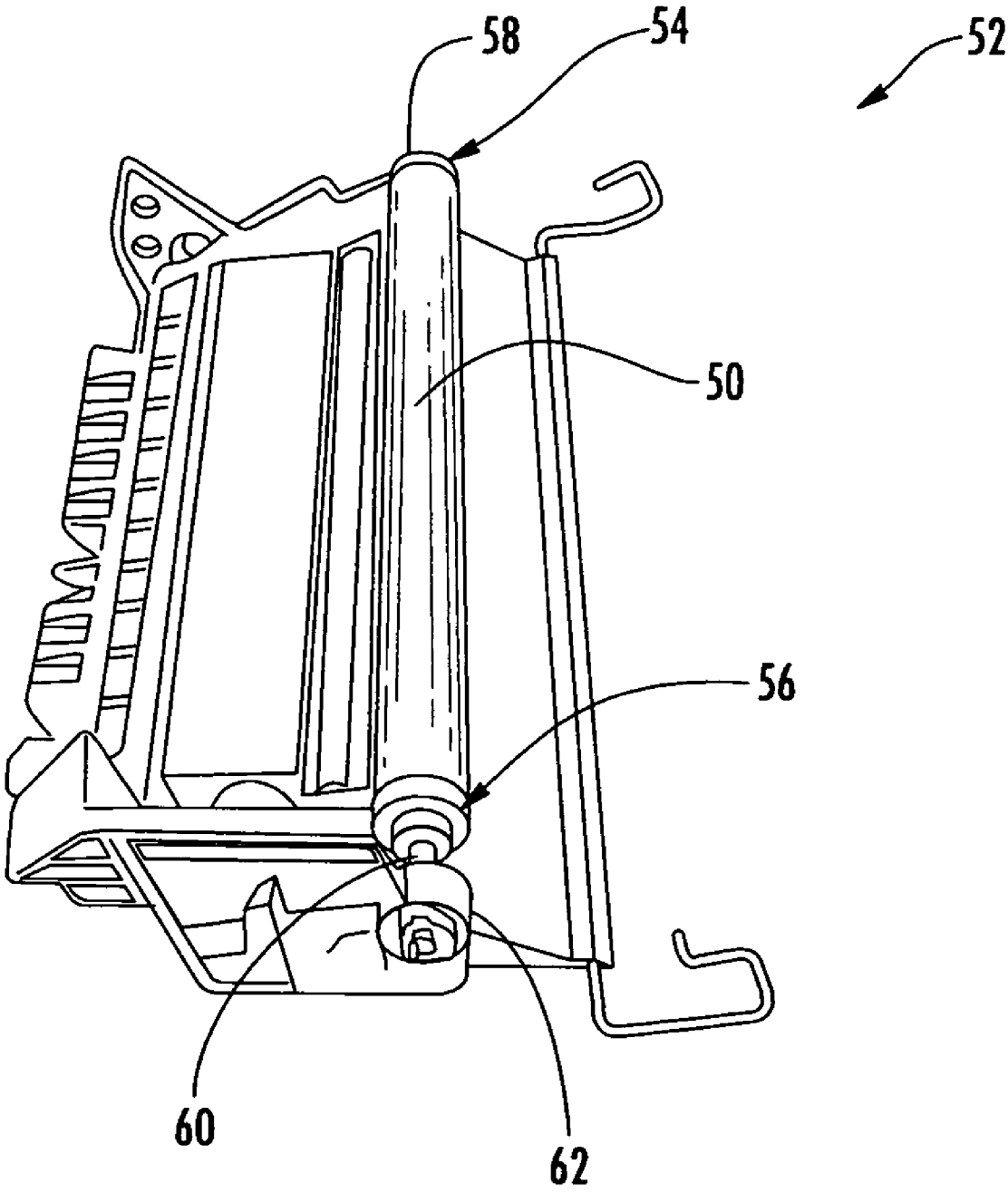
FIG. 4 (PRIOR ART)
FIG. 4 is substantially a top plan view of a prior art cartridge for which the various embodiments of the pin driver of the present invention may be used.

Referring now to FIG. 4, a drum 50 typically has a first end 54 and a second end 56. The first end 54 is typically attached to a first cartridge portion 58 of the cartridge 52. The second end 56 is typically attached to a drum axle 60. The drum axle 60 is typically a piece of shaft that connects the drum 50 to a motor of a printer to allow the motor to rotate the drum. The drum axle is typically attached to a second cartridge portion 62.

Figure 5:
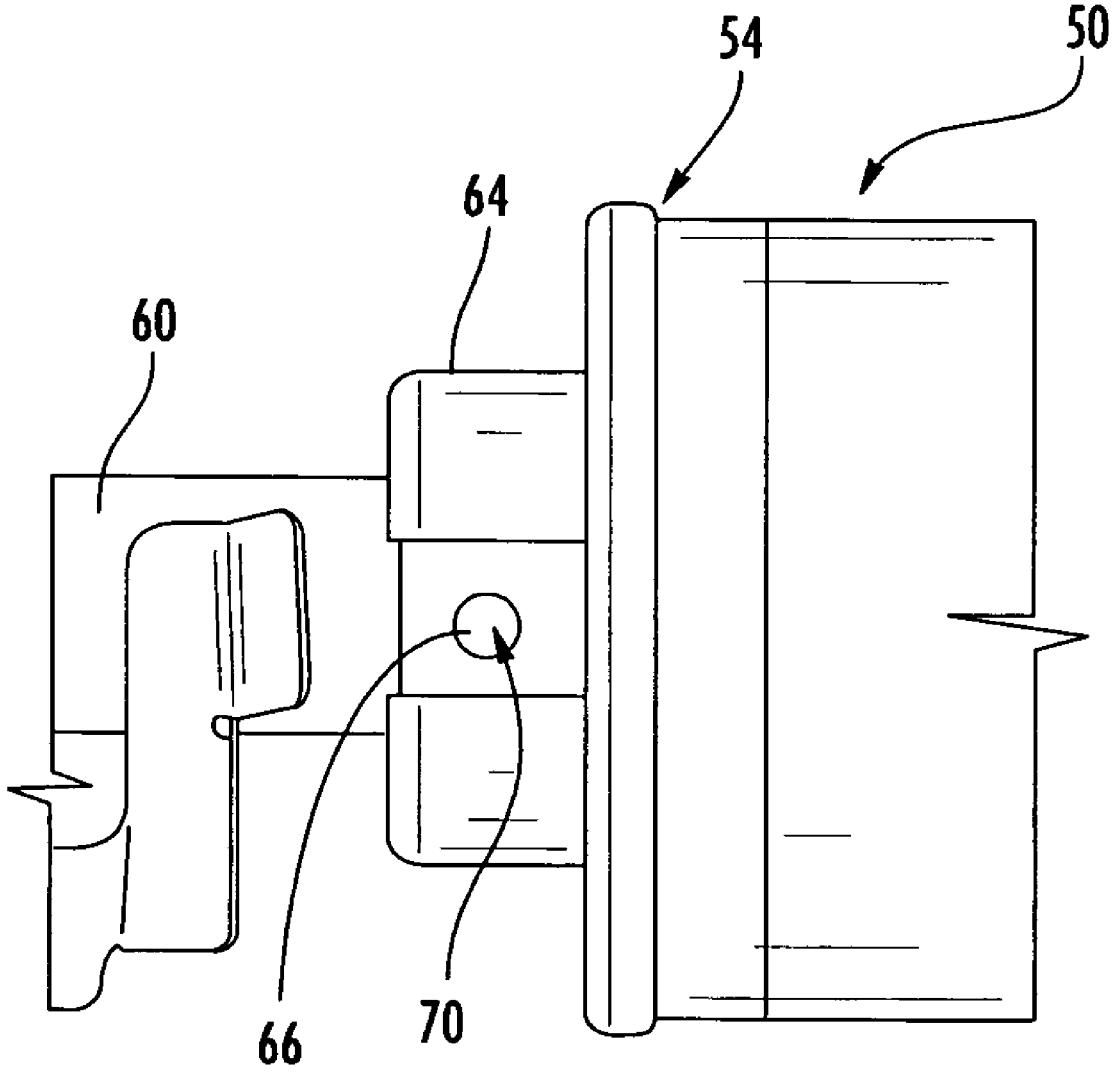
FIG. 5 (PRIOR ART)
FIG. 5 is substantially a front elevational view of the portion of the cartridge in FIG. 4 that includes the drum and the drum axle.
Figure 6:
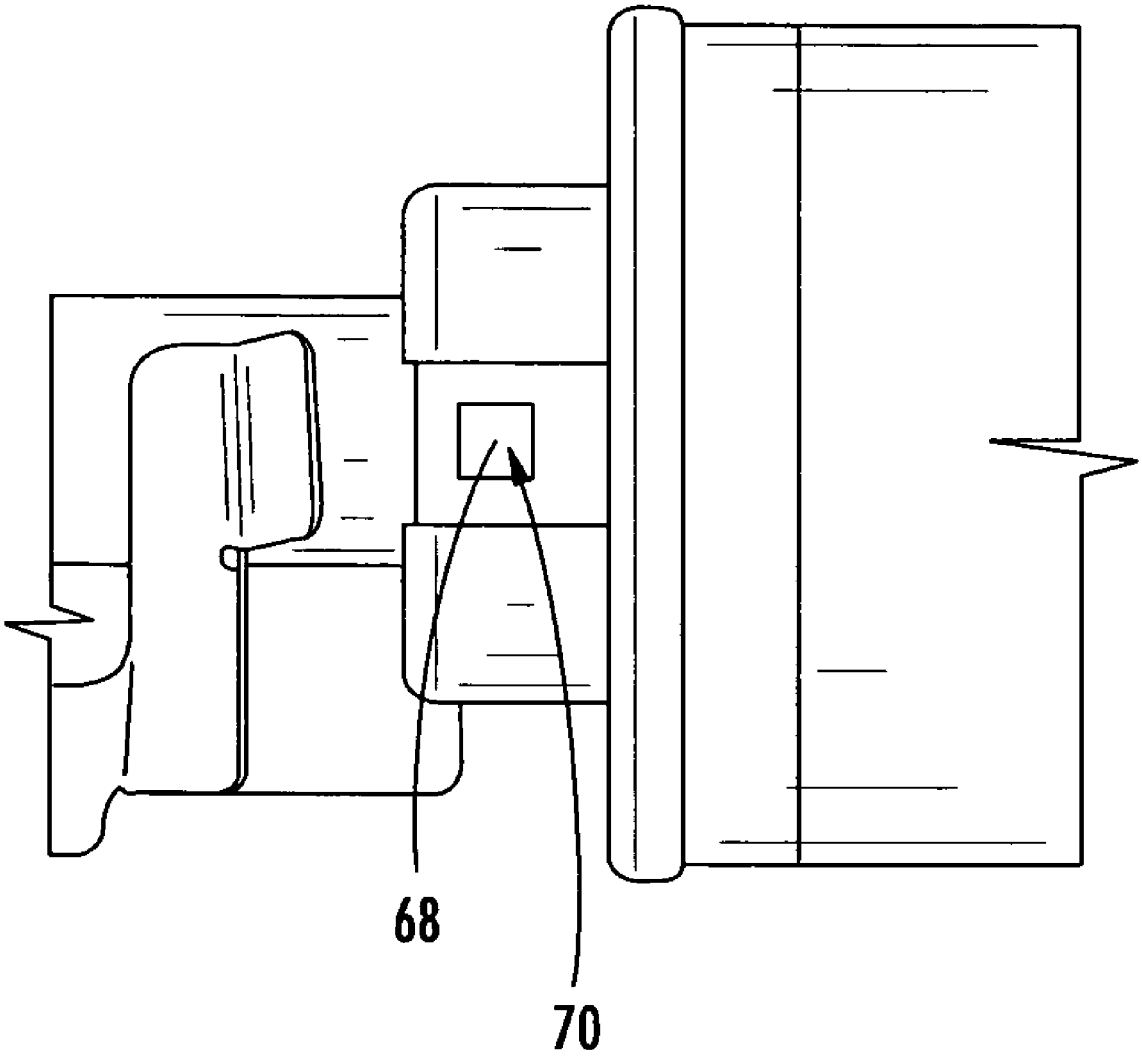
FIG. 6 (PRIOR ART)
FIG. 6 is substantially a rear elevational view of the same cartridge portion as in FIG. 5.
Figure 7:
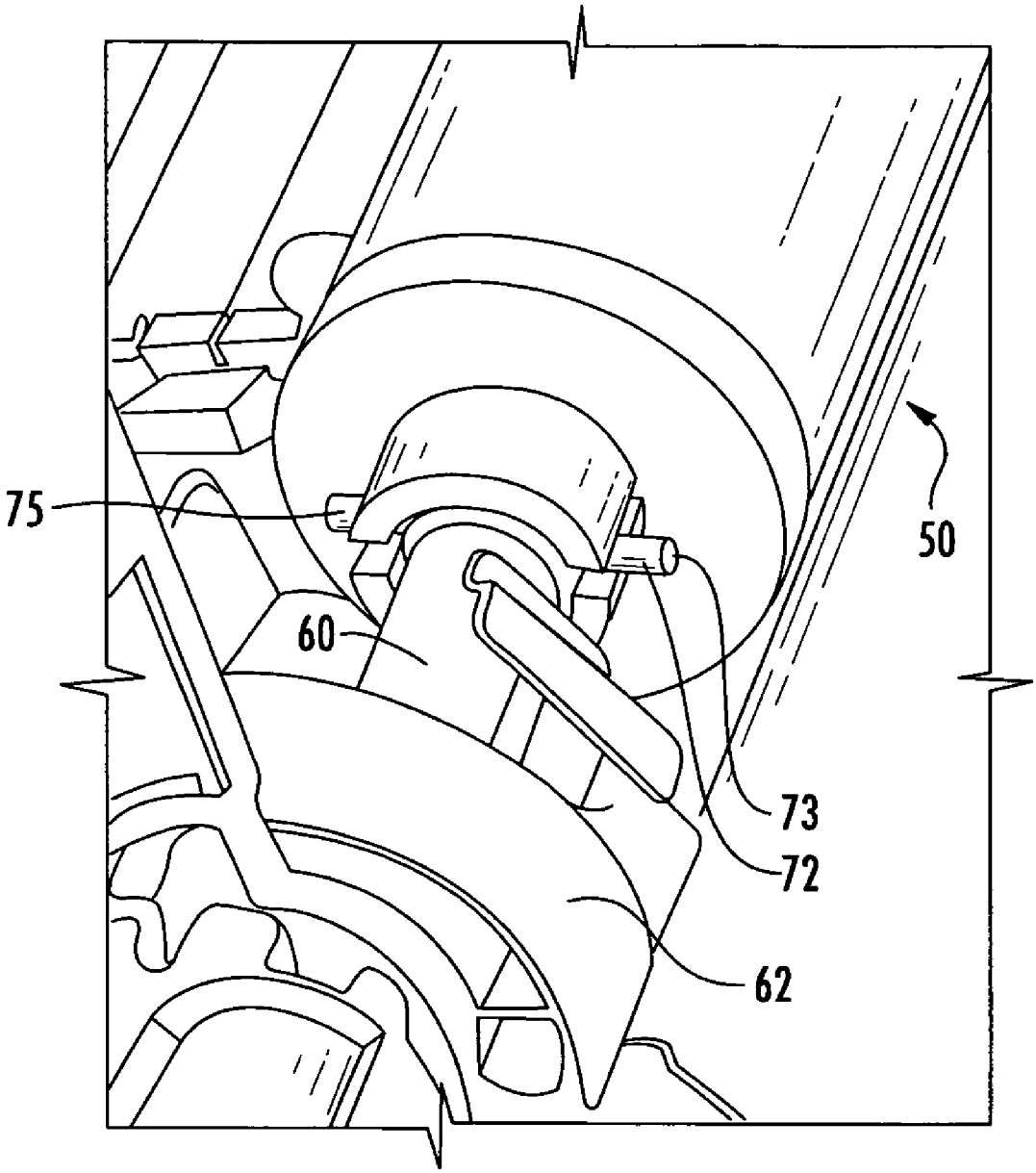
FIG. 7 (PRIOR ART)
FIG. 7 is substantially a perspective view of the same cartridge portion as in FIG. 5 with a pin attaching the drum to the drum axle.

With reference now to FIGS. 5 and 6, the first end 54 of the drum 50 may include a drum hub 64. The drum hub 64 may define a pair of opposing recesses, which may be a circular recess 66 on one end (FIG. 5) and a square recess 68 on the other end (FIG. 6). The drum hub 64 may be attached to a drum axle 60, which may define a drum axle recess. The drum axle recess may be aligned with the pair of opposing recesses 66 and 68 of the drum hub to form a pin passage 70. A drum spring pin 72 is typically inserted through the pin passage 70 to attach the drum 50 to the drum axle 60 (FIG. 7). The drum spring pin 72 may be hollow, and each drum spring pin end may define a corresponding drum spring pin recesses 73 and 75. The drum axle 60 may be attached to the second cartridge portion 62. Thus, the second end 56 of the drum 50 is indirectly attached to the cartridge via the drum axle 60.

Figure 8:
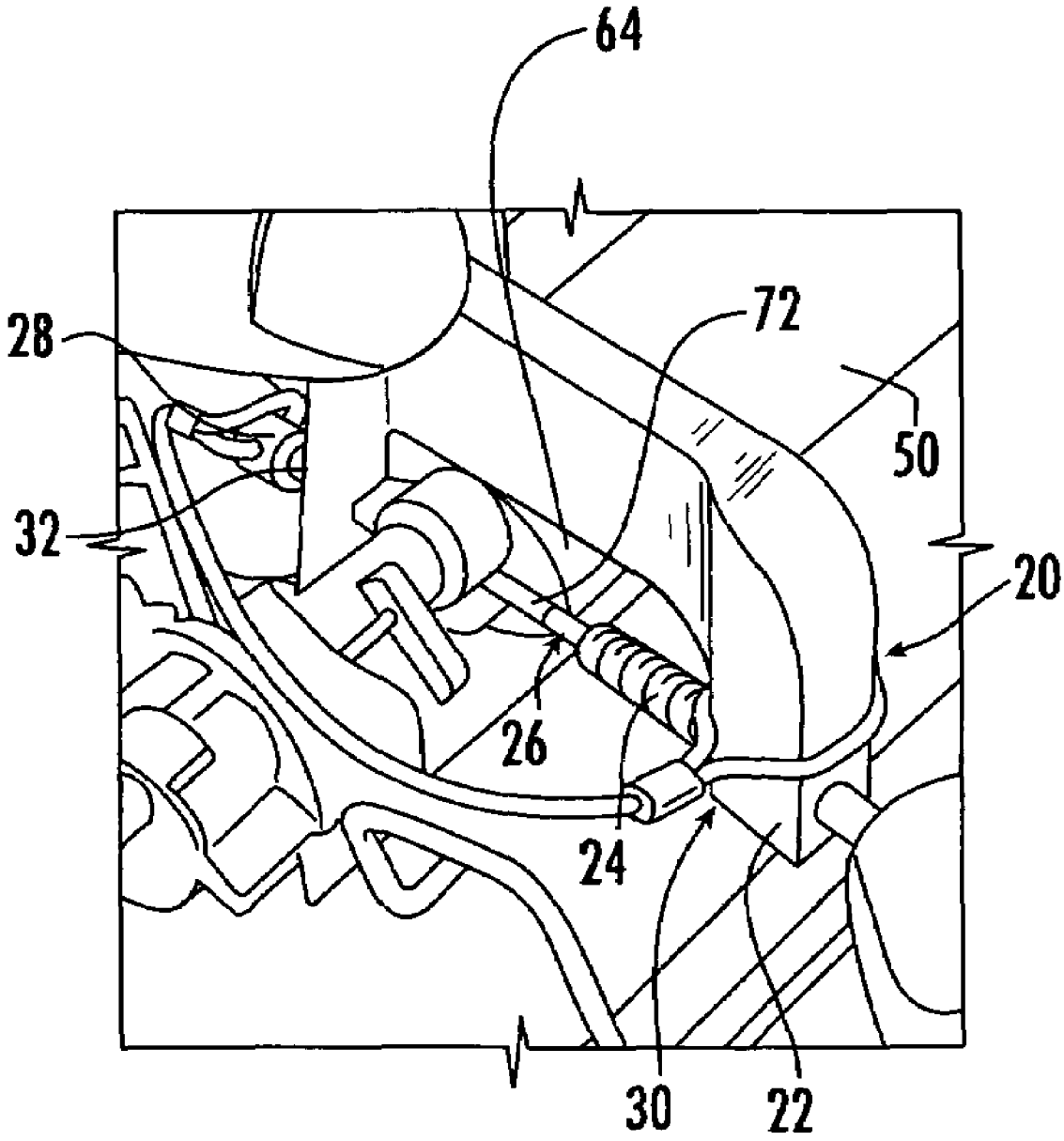
FIG. 8 is substantially a perspective view similar to FIG. 7, but with the pin driver embodiment shown in FIG. 1 being used.

Referring now to FIG. 8, once the cartridge has been disassembled to provide access to the drum 50, the pin driver 20 is preferably positioned around the drum 50 such that the C-shaped tool body 22 is over the drum hub 64. The drum hub 64 is preferably positioned in between the first end 30 and the second end 32 of the tool body 22. If the drum hub 64 is of the type that includes a circular recess on one end and a square recess on another, the drum 50 is preferably rotated such that the first end 30 of the tool body 22 is facing the circular recess. The alignment pin 28 may be inserted through the second recess 42 defined by the second end 32. The shaft 24 may be rotated, and the engagement pin 26 may be aligned with the drum spring pin 72 to be removed. Once the shaft 24 has been extended such that the engagement pin 26 contacts the drum spring pin 72, the pin contact portion 48 of the engagement pin 26 may then be inserted into the recess 73 of the drum spring pin 72.

Figure 9:
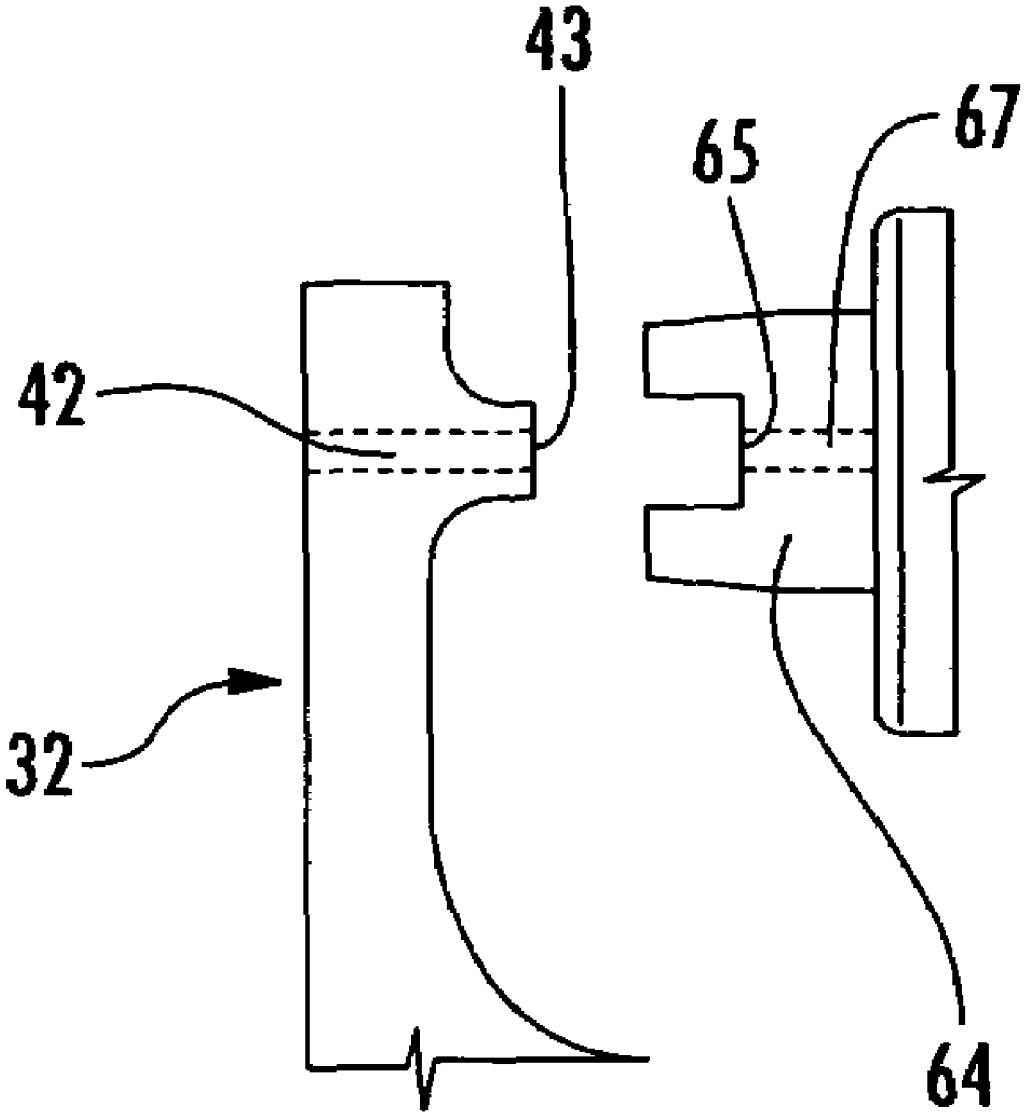
FIG. 9 is substantially a schematic view of an end of the pin driver and a portion of a drum hub to which the pin driver end may be configured to abut.

The shaft 24 may be rotated until the second end 32 of the tool body 22 abuts the drum hub 64 (FIG. 9). The drum hub 64 may include an indented sub-structure 65, which defines the recess 67 for the drum spring pin 72. The second end 32 of the tool body 22 may include a protruding portion 43 designed to fit within the indented sub-structure 65 of the drum hub. Once the protruding portion 43 of the second end 32 abuts the indented sub-structure 65 of the drum hub, the shaft 24 may be rotated until the alignment pin 28 is withdrawn from the second recess 42 and the drum spring pin 72 is detached from the drum hub. A portion of the engagement pin may have to be inserted through the pin passage to drive the drum spring pin 72 out of the drum hub. It can be appreciated that the protruding portion 43 aids in providing a much precise alignment between the second recess 42 and the pin recess 67. The precise alignment may minimize the exposure of the drum spring pin from being damaged.

Drum Re-Assembly

Unlike the conventional methods described above, the pin driver 20 may provide leverage during both disassembly and re-assembly. To use the pin driver 20 during re-assembly, the pin driver 20 may be positioned around the drum 50 such that the C-shaped tool body 22 is over the drum hub 64. The drum hub 64 is preferably positioned in between the first end 30 and the second end 32 of the tool body 22. If the drum hub 64 is of the type that includes a circular recess on one end and a square recess on another, the drum 50 is preferably rotated such that the first end 30 of the tool body 22 is facing the square recess. The drum spring pin 72 is preferably inserted through the square recess. If the drum hub 64 does not have two types of recesses, then the drum spring pin 72 may be inserted through any drum hub recess.

The second end 32 may be positioned to abut the drum hub 64, and the alignment pin 28 may be inserted through the second recess 42 of the second end 32. A portion of the alignment pin 28 may be inserted through the pin passage 70 defined by the drum hub and the drum axle. The shaft 24 may be rotated, and the engagement pin 26 may be aligned with the drum spring pin 72. The pin contact portion 48 of the engagement pin 26 may then be inserted into the recess of the drum spring pin 72. The shaft 24 may be rotated until the drum spring pin 72 pushes out the alignment pin 28 or the desired length of insertion of the drum spring pin 72 through the pin passage is achieved.

It can now be realized that the present invention provides tools and methods for effectively detaching and reattaching a drum of a cartridge. The present invention eases the step of aligning the mechanical spring pin with the device used to drive the mechanical spring pin out of the drum and the drum axle. The tools and methods of the present invention help minimize the exposure of sensitive parts of the drum to being damaged. For instance, the present invention helps ensure that the drum spring pin, the parts of the pin driver, or the pin removal technique does not alter the physical characteristic hub of the drum, which is often manufactured with soft plastic. The present invention helps minimize the exposure of the drum spring pin from being damaged. It can further be appreciated that the tools and methods of the present invention may provide leverage in re-installing the drum to the cartridge. The present invention provides tools and methods that may be desirable in high volume cartridge remanufacturing environments.

Although the description above contains many specifications, these should not be construed as limiting the scope of the invention but as merely providing illustrations of some of the presently preferred embodiments of this invention. For example, the lengths and the numbers of the various shafts of the pin driver may be varied. The shape and the thickness of the tool body may be varied. The invention is capable of other embodiments and of being practiced and carried out in various ways. The invention is not limited in its application to the details of the construction and to the arrangement of the components set forth in the above description or as illustrated in the drawings.

What is claimed is:

1. A device for driving a pin that fastens a printer cartridge drum to a drum axle, the pin comprising a first pin end that defines a pin recess and a second pin end opposite the first pin end, the device comprising:

a first shaft having a plurality of male threads protruding from and surrounding the first shaft;

a second shaft attached to the first shaft at a first end of the second shaft, the second shaft comprising a diameter that is smaller than the diameter of the first shaft, the second shaft further comprising a tapering end opposite the first end, the tapering end being configured to contact the pin at the first pin end and fit within the pin recess;

a shaft receiver defining a shaft receiver recess, the shaft receiver recess configured to accommodate the first shaft, the first shaft being moveable within the recess, wherein the movement of the first shaft is configured to drive the pin and detach the printer cartridge drum from the drum axle;

a C-shaped body, the shaft receiver being positioned on a first end of the body, the C-shaped body comprising a second end opposite the first end, the second end defining a second end recess, the second end recess being configured to receive the pin being driven by the first shaft;

an alignment pin shaft configured to hold the pin from the second pin end; and, a tie comprising a first end attached to the C-shaped body and a second end attached to the alignment pin shaft.

2. The device of claim 1, further comprising a shaft handle attached to the first shaft.

3. A device for driving a pin that fastens a printer cartridge drum to a printer cartridge on at least one end of the printer cartridge drum, the device comprising:

a device body defining a device body recess; and, a shaft configured to be inserted in the device body recess and to be moved within the device body recess, wherein the movement of the shaft within the device body recess is configured to drive the pin and alter the attachment of the printer cartridge drum to the printer cartridge at the at least one end of the printer cartridge drum, wherein the shaft comprises a plurality of male threads protruding from the shaft, the shaft being configured to be moved within the device body recess by rotation.

4. The device of claim 3, wherein the shaft comprises a tapered end and the pin comprises a first pin end, the first pin end defining a pin recess, wherein at least a portion of the tapered end of the shaft is configured to fit within the pin recess.

5. The device of claim 3, wherein the pin comprises a first pin end, the first pin end defining a pin recess, wherein at least a portion of the shaft is configured to be secured within the pin recess.

6. The device of claim 3, wherein the printer cartridge drum is attached to the printer cartridge by the pin inserted through a portion of the printer cartridge drum and a portion of a drum axle, the portion of the printer cartridge drum and the portion of the drum axle defining a pin passage extending through the portions, at least a portion of the shaft being configured to go through the pin passage.

7. A method of moving a pin configured to attach a printer cartridge drum to a portion of a printer cartridge, the pin passing through a pin passage defined by a printer cartridge drum portion and a drum axle portion, the method comprising:

providing a shaft configured to rotate within a recess defined by a tool body;

allowing the shaft to contact the pin; and rotating the shaft to drive the pin.

8. The method of claim 7 further comprising detaching the pin from the printer cartridge drum portion and the drum axle portion thereby detaching the printer cartridge drum from the printer cartridge portion.

9. The method of claim 7, wherein the tool body comprises a C-shaped structure, the C-shaped structure comprising a first end defining the recess where the shaft is positioned and a second end defining a second recess, the method further comprising aligning the second recess with the pin passage.

10. The method of claim 7, further comprising allowing a portion of the shaft to enter the pin passage.

11. The method of claim 9, further comprising:

providing a second shaft, the second shaft configured to be inserted through the second recess; and inserting a portion of the second shaft through the pin passage.

12. The method of claim 7, further comprising:

inserting a pin through the pin passage; and driving the pin through the pin passage thereby attaching the printer drum to the printer cartridge portion.

13. The method of claim 12, wherein the tool body comprises a C-shaped structure, the C-shaped structure comprising a first end defining the recess where the shaft is positioned and a second end defining a second recess, the method further comprising aligning the second recess with the pin passage and allowing the second recess to receive the pin.

14. The method of claim 13, further comprising:

providing a second shaft, the second shaft configured to be inserted through the second recess;

inserting a portion of the second shaft through the pin passage; and allowing the portion of the second shaft to contact the pin.

* * * * *